US008540427B2

(12) United States Patent
Steele

(10) Patent No.: US 8,540,427 B2
(45) Date of Patent: Sep. 24, 2013

(54) GUSSETED PACKAGE WITH IMPACT BARRIER

(76) Inventor: Mark Steele, New Prague, MN (US)

( * ) Notice: Subject to any disclaimer, the term of this patent is extended or adjusted under 35 U.S.C. 154(b) by 431 days.

(21) Appl. No.: 12/400,304

(22) Filed: Mar. 9, 2009

(65) Prior Publication Data

US 2009/0245699 A1 Oct. 1, 2009

Related U.S. Application Data

(60) Provisional application No. 61/034,582, filed on Mar. 7, 2008.

(51) Int. Cl.
*B65D 30/20* (2006.01)

(52) U.S. Cl.
USPC ..... 383/120; 383/210

(58) Field of Classification Search
USPC ..... 383/61.3, 107, 120, 210, 210.1
See application file for complete search history.

(56) References Cited

U.S. PATENT DOCUMENTS

| | | | | |
|---|---|---|---|---|
| 2,192,722 | A * | 3/1940 | Vogt | 229/117.33 |
| 3,172,443 | A * | 3/1965 | Ausnit | 383/203 |
| 3,224,640 | A | 12/1965 | Schneider | |
| 3,390,507 | A | 7/1968 | Repko | |
| 4,155,453 | A | 5/1979 | Ono | |
| 4,201,031 | A | 5/1980 | Wiles | |
| 4,256,256 | A | 3/1981 | Meyers | |
| 4,402,402 | A | 9/1983 | Pike | |
| 4,519,499 | A | 5/1985 | Stone | |
| 4,703,518 | A | 10/1987 | Ausnit | |
| 4,736,450 | A | 4/1988 | Van Erden | |
| 5,060,803 | A | 10/1991 | Beer | |
| 5,116,301 | A | 5/1992 | Robinson | |
| 5,209,347 | A | 5/1993 | Fabisiewicz | |
| 5,407,278 | A | 4/1995 | Beer | |
| 5,409,116 | A | 4/1995 | Aronsen | |
| 5,480,230 | A * | 1/1996 | May | 383/9 |
| 5,492,219 | A | 2/1996 | Stupar | |
| 5,547,284 | A | 8/1996 | Imer | |
| 5,672,009 | A | 9/1997 | Malin | |
| 5,692,837 | A * | 12/1997 | Beer | 383/210.1 |
| 5,951,453 | A | 9/1999 | Yeager | |
| 5,952,025 | A | 9/1999 | Yannuzzi | |
| 5,972,396 | A | 10/1999 | Jurgovan | |
| 6,036,004 | A | 3/2000 | Bowen | |
| 6,040,033 | A | 3/2000 | Johnson | |
| 6,053,635 | A | 4/2000 | Steele | |
| 6,065,872 | A | 5/2000 | Johnson | |
| 6,065,873 | A | 5/2000 | Fowler | |
| 6,115,892 | A | 9/2000 | Malin | |
| 6,176,615 | B1 | 1/2001 | Leimkuehler | |
| 6,177,172 | B1 | 1/2001 | Yeager | |
| 6,186,663 | B1 | 2/2001 | Ausnit | |

(Continued)

FOREIGN PATENT DOCUMENTS

| | | |
|---|---|---|
| EP | 0 063 013 | 10/1982 |

*Primary Examiner* — Hemant M Desai
*Assistant Examiner* — Gloria R Weeks
(74) *Attorney, Agent, or Firm* — Skaar Ulbrich Macari, P.A.

(57) ABSTRACT

A package having a gusseted panel portion is depicted and described. The package generally includes opposing panel portions that at least partially define an interior cavity or compartment therebetween that is accessible through an access device. The gusseted panel portion provides a material impact barrier within the interior cavity or compartment of the package to assist in protecting the access device from the impact or load of material contents within the package.

19 Claims, 11 Drawing Sheets

(56) References Cited

U.S. PATENT DOCUMENTS

| | | | | |
|---|---|---|---|---|
| 6,234,675 | B1 | 5/2001 | Saad | |
| 6,245,367 | B1 | 6/2001 | Galomb | |
| 6,270,257 | B1 | 8/2001 | Yeager | |
| 6,325,543 | B1 * | 12/2001 | Ausnit | 383/210.1 |
| 6,361,209 | B1 * | 3/2002 | LaRue et al. | 383/10 |
| 6,371,643 | B2 | 4/2002 | Saad | |
| 6,375,037 | B1 | 4/2002 | Bell | |
| 6,378,177 | B1 * | 4/2002 | Athans et al. | 24/585.12 |
| 6,478,465 | B1 | 11/2002 | Thrall | |
| 6,481,183 | B1 | 11/2002 | Schmidt | |
| 6,533,711 | B1 | 3/2003 | Anderson | |
| 6,572,266 | B2 * | 6/2003 | Buchman | 383/5 |
| 6,641,307 | B2 | 11/2003 | Matsuda | |
| 6,659,645 | B1 * | 12/2003 | Schulz | 383/210 |
| 6,726,364 | B2 | 4/2004 | Perell | |
| 6,752,264 | B2 | 6/2004 | Versluys | |
| 6,820,391 | B2 | 11/2004 | Barmore | |
| 6,863,646 | B2 * | 3/2005 | Kinigakis et al. | 493/213 |
| 6,874,935 | B2 * | 4/2005 | Edelman et al. | 383/5 |
| 7,040,810 | B2 | 5/2006 | Steele | |
| 7,192,191 | B2 * | 3/2007 | Wedi et al. | 383/64 |
| 7,207,717 | B2 | 4/2007 | Steele | |
| D549,594 | S | 8/2007 | Steele | |
| 7,413,535 | B2 | 8/2008 | Schneider | |
| 7,506,487 | B2 * | 3/2009 | Eads et al. | 53/412 |
| D621,280 | S | 8/2010 | Steele | |
| 7,866,011 | B2 * | 1/2011 | Greco et al. | 24/399 |
| 7,883,268 | B2 | 2/2011 | Steele | |
| 7,988,359 | B1 * | 8/2011 | Sussman et al. | 383/10 |
| 8,142,077 | B2 * | 3/2012 | Iannelli et al. | 383/64 |
| 2003/0210838 | A1 | 11/2003 | Steele | |
| 2004/0031244 | A1 | 2/2004 | Steele | |
| 2004/0231292 | A1 | 11/2004 | Perell | |
| 2005/0069227 | A1 | 3/2005 | Steele | |
| 2006/0113212 | A1 | 6/2006 | Steele | |
| 2006/0215942 | A1 | 9/2006 | Steele | |
| 2007/0189641 | A1 | 8/2007 | Steele | |
| 2008/0002918 | A1 | 1/2008 | Steele | |
| 2008/0240623 | A1 | 10/2008 | Bell | |
| 2008/0279485 | A1 | 11/2008 | Steele | |
| 2008/0296310 | A1 | 12/2008 | Steele | |
| 2009/0080810 | A9 | 3/2009 | Steele | |
| 2009/0180716 | A1 | 7/2009 | Steele | |
| 2009/0208147 | A1 | 8/2009 | Steele | |
| 2009/0238499 | A1 | 9/2009 | Steele | |
| 2009/0245699 | A1 | 10/2009 | Steele | |
| 2009/0277916 | A1 | 11/2009 | Steele | |
| 2010/0012531 | A1 | 1/2010 | Steele | |
| 2010/0226600 | A1 | 9/2010 | Steele | |
| 2011/0033138 | A1 * | 2/2011 | Cameron et al. | 383/210 |
| 2011/0042407 | A1 | 2/2011 | Steele | |
| 2011/0103714 | A1 | 5/2011 | Steele | |
| 2011/0182531 | A1 | 7/2011 | Steele | |

* cited by examiner

GUSSETED PACKAGE WITH IMPACT BARRIER

PRIORITY APPLICATIONS

This application claims priority to and the benefit of U.S. Provisional Application No. 61/034,582, filed Mar. 7, 2008, which is hereby fully incorporated herein by reference.

FIELD OF THE INVENTION

The present invention relates generally to flexible packaging and, more particularly, to packages, and methods for forming and using packages, having a gusseted portion to provide an internal material impact barrier to protect portions and devices in packages adapted to hold or carry relatively large or heavy material contents.

BACKGROUND OF THE INVENTION

Flexible packages used for items like pet food and lawn and garden products are generally large in size, and hold and carry relatively large contents. These types of products and packages can be used over and over again. As such, top seals or closure devices, such as zippers and other re-closeable devices and methods, in the packages must be protected and remain functional to ensure this continued use. In addition, the re-closeable devices and methods must remain easy to implement and operate. This presents an inherent problem because the heavier material contents can damage those critical package features.

Moreover, larger and heavier packages must undergo what is often called a "drop test" to ensure that the package can withstand the rigors of shipping, handling, and extended use. A typical drop test involves placing a filled package on a platform, normally three feet high from the floor. The platform is then swung out or otherwise removed, allowing the package to drop. The package is typically dropped on its front, back, and ends in further drop testing.

Many of the package types being used for these bulk products are packages with side gussets, as they expand to accommodate large volumes of products. Although there are ways of attaching zippers or other re-closable devices in-line (e.g., machine direction) while the package is being made, there are also means of attaching the devices to the package after it is made and before it is filled with product. To date, this is a common means of attaching slider style re-closable zippers. Also, because side gusseted packages can be difficult to open, and easy opening is a feature the consumers expect, most slider zippers being used are exposed at the top of the package.

Some packages, such as those disclosed in U.S. Patent Application Publication 20080050056, may include various zipper configurations utilized to protect the structure from shock loading. However, these methods utilize the zipper device materials to increase protection, which in turn can increase formation, material and labor costs. Further, additional membranes or device materials must be made strong enough to handle the shock loading, which in turn makes it more difficult for the consumer to gain access to the package openings.

As a result, there is a need for a flexible package that substantially solves the above-referenced problems with conventional package designs, configurations, and manufacturing methods.

SUMMARY OF THE INVENTION

The present invention solves many of the problems facing flexible packages and the packaging industry. Embodiments of the present invention are directed to a package generally including at least one front and back panel defining an interior compartment accessible through an access opening. The package can further include one or more side panel portions, gusseted or non-gusseted. The interior is capable of storing and dispensing product and other objects, including relatively large or heavy materials. The package includes a gusset portion formed at a portion, such as the top portion, of the front or back panel portions to provide a focal impact region. The gusset portion extends generally between or across the top portions of the front and back panel portions such that a gusseted top region is formed distinct or distinguishable from the front and back panel portions. An edge region of the gusset panel portion can be sealed or otherwise joined, directly or indirectly, to an interior sealant surface of the front or back panel portions to define the impact or material barrier extending into the internal compartment.

By forming the gusseted portion in the package, a flexible material is provided proximate the re-closeable device, such as a zipper, that provides an alternate impact region for the contents of the material. This impact region can protect the re-closeable device from the potentially damaging energy and shifting of the material contents of the package during shipping, handling, and use. Because the gusset is taking the vast majority of the impact energy or load, nearly any zipper or other re-closeable device can be employed. Namely, there is no need for zippers made of increased thickness or material strength because the zippers, or other devices, are no longer required to take the damaging impact and pressure of the material contents.

Figure 1:
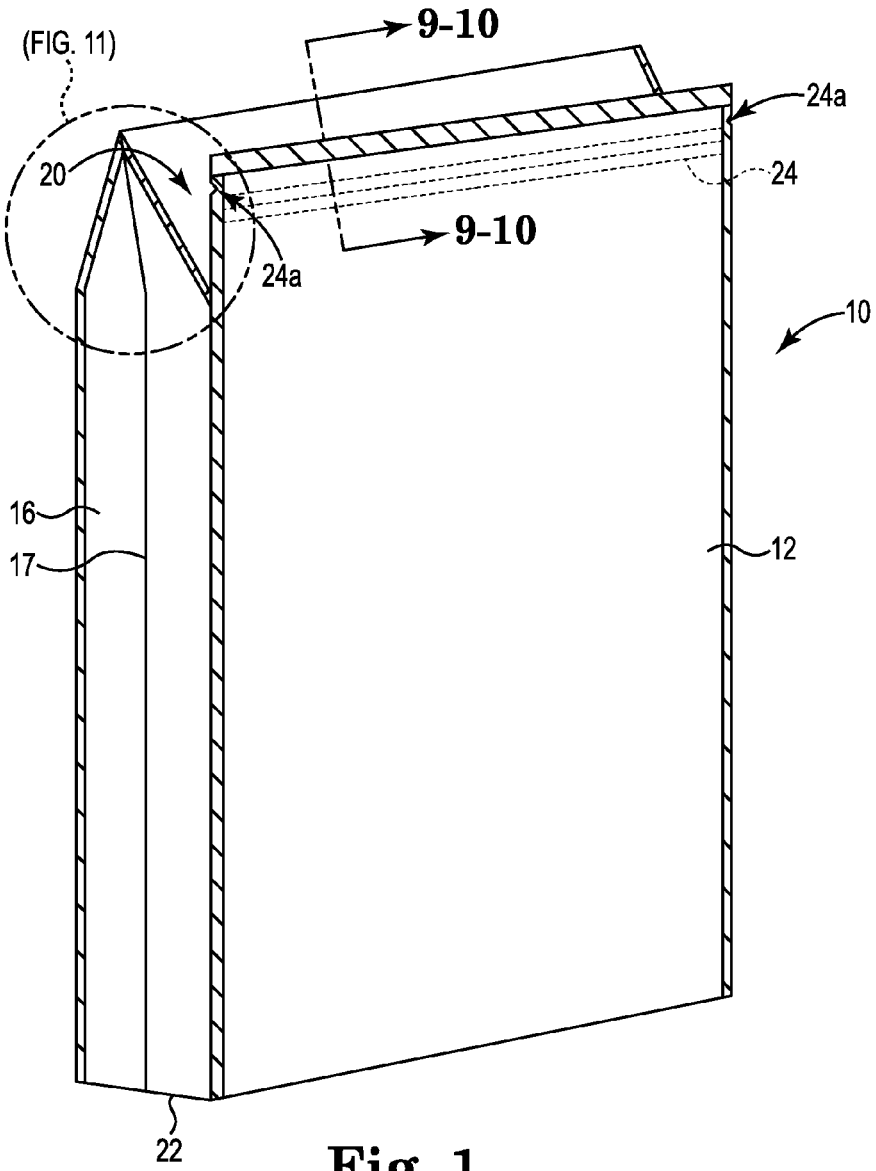
FIG. 1 is a perspective view of a package having a gusseted impact barrier and side panels in accordance with an embodiment of the present invention.
Figure 2:
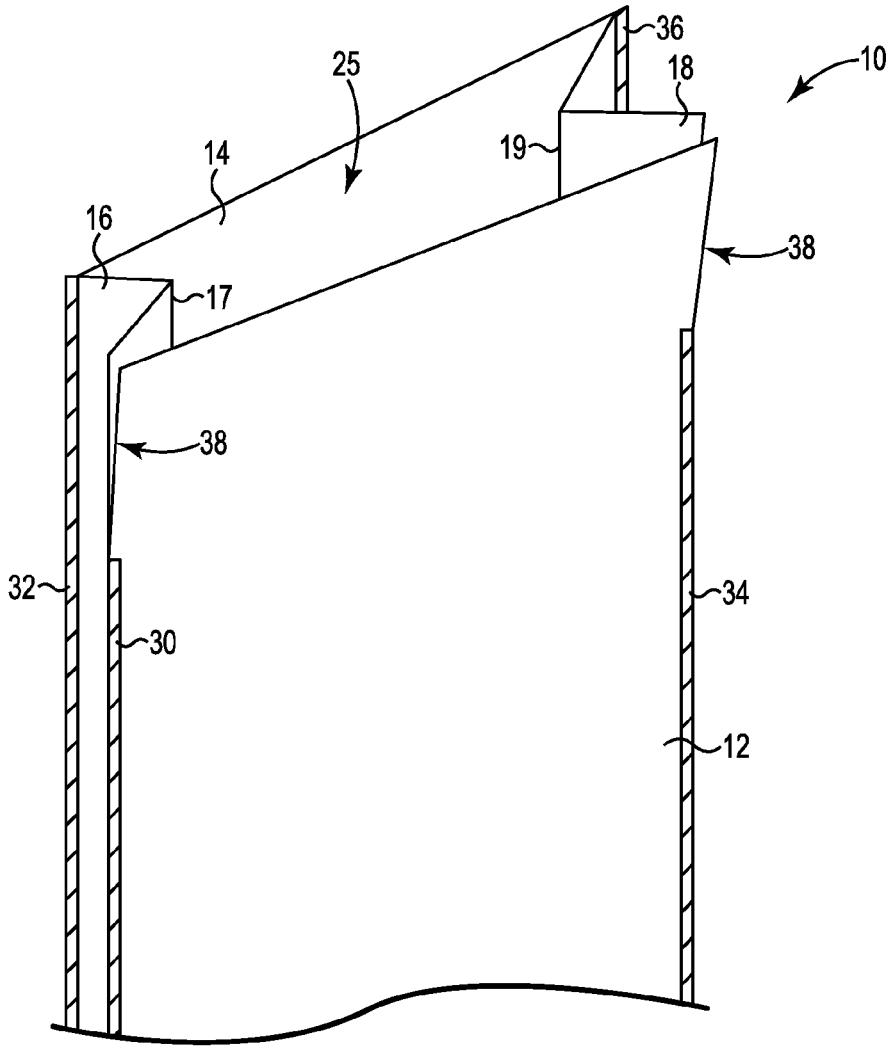
FIG. 2 is a perspective view of a package folded at the side gusset panels in accordance with an embodiment of the present invention.
Figure 3:
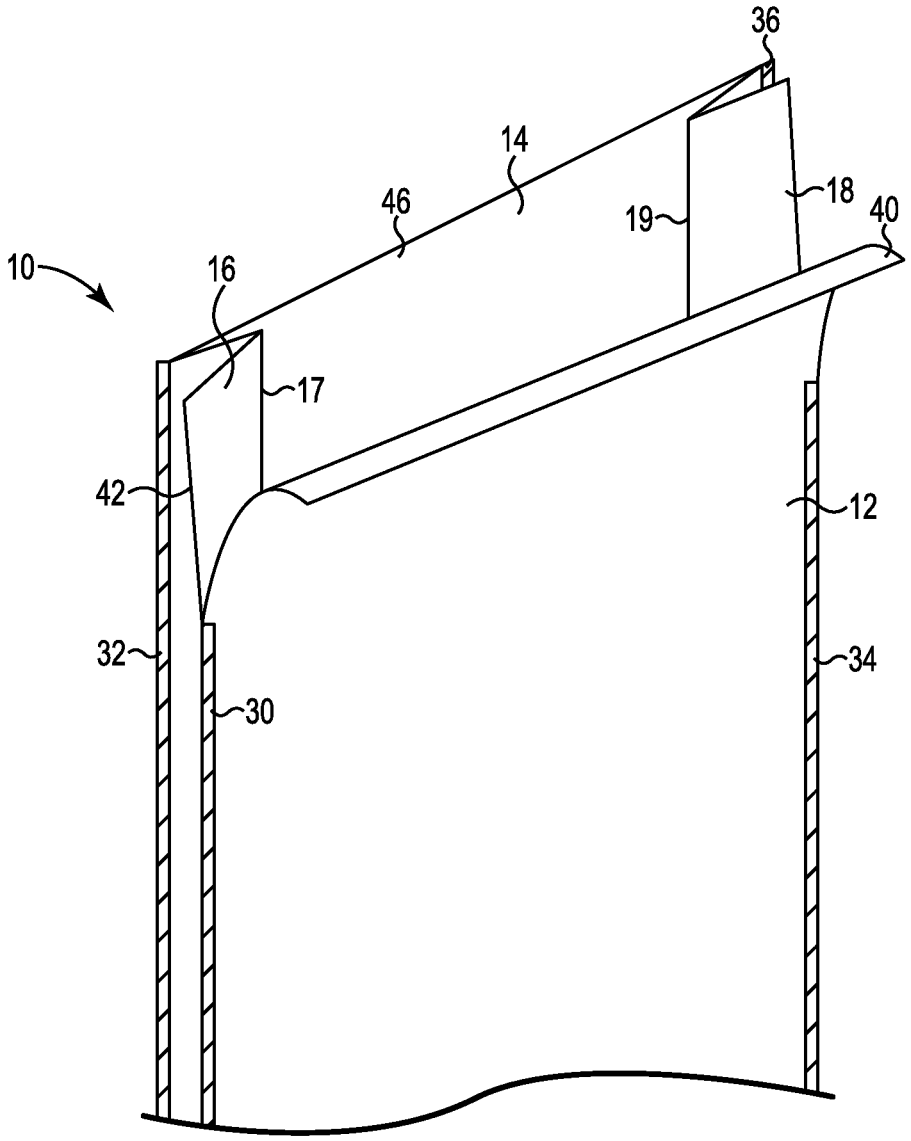
FIG. 3 is a perspective view of the package of FIG. 2 folded at the side gusset panels in accordance with an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, cross-hatching, dashing or shading in the figures is provided to demonstrate sealed portions and/or integrated regions or devices for the package.

DETAILED DESCRIPTION OF THE PREFERRED EMBODIMENTS

A purpose of the present invention is to form a package, such as a flexible package, to have a gusseted portion, allowing for increased protection of an access region or device provided in the package proximate the gusseted portion. The various embodiments and teachings provided herein can also be employed with a rigid or semi-rigid package, or simply to create a gusseted portion with or without re-closeable devices. Further, references to "top," "bottom," and the like are for illustrative purposes only and are not meant to limit the scope of the disclosed invention. For instance, the "top" gusset invention could be just as easily employed in the bottom or side portions of the package to form a gusseted package.

Referring generally to FIGS. 1-18, a flexible package 10 and components and configurations in accordance with embodiments of the present invention are shown. The package 10 generally includes a front panel portion 12, a back panel portion 14, an access region or device 24, and a gusseted impact panel portion 20. In addition, the package 10 can include one or more side panel portions 16, 18 and a bottom panel portion 22, gusseted or non-gusseted. Each side panel 16, 18 can be gusseted to define corresponding gusset lines or folds 17, 19. In the depicted embodiments, the joining and/or forming of the above-referenced panels define the package 10 with an internal cavity or compartment 25 accessible through a package opening 23, generally having an adjustable internal volume capacity for holding material contents 11. The panels 12-22 are often referred to as "webs" or films. Each panel can be formed from an individual web or, alternatively, each of the panels can be portions of a larger single web, wherein the large web is folded, cut and/or shaped to define the individual and distinct panel portions and, ultimately, the shape and size of the package 10. Further, in one embodiment, the top 20 and bottom 22 panel portions can be formed by the selective joining of the respective end portions of the panels 12, 14 some size measurably longer than the panels 16, 18 to provide necessary material for folding to form panel portions 20, 22. Regardless of the formation techniques or the use of separate web panels, a designated and distinguishable panel portion is defined for each panel. Further, one or more of the panel portions can be gusseted.

In an upright flexible package 10, the side panels 16, 18 can be defined as those panels with a distance measurement between the longitudinal sides being some distance shorter than a distance between the longitudinal sides on adjacent front 12 and/or back panels 14.

The package panel portions 12-22 are generally constructed of flexible sheet material such as polyethylene, polyester, metal foil, polypropylene, or polyethylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The package 10 and its portions can be formed to provide a stand-up pouch, pre-made pouch, bag-top, one formed and filled on a "form-fill-seal" machine, and other known package designs and configurations. Other known package designs and packaging techniques and features can be adapted to incorporate or form the configuration of the present invention as well.

The access region or device 24 can be a re-closeable device that is disposed on or integrated to at least one of the front or back panel portions 12, 14, and capable of multiple re-closeable uses. Fixed zippers, slider zippers, adhesives/tapes, snap or screw cap devices, snap fasteners, hook and latch fastening, spouts, fitments, and other like techniques and devices known to one skilled in the art can be employed for use as the device 24. In addition, the access device 24 can be provided to the package 10 during the machining or formation process, or pre-applied to a section of material or web prior to package formation. The apparatus and methods disclosed in U.S. Pat. Nos. 6,019,512 and 6,516,850 for integrating zippers into a flexible package are incorporated herein by reference except for express definitions contained therein. In addition, other machines consistent with that disclosed herein, and technologies for attaching access opening devices to flexible packaging sheets or webs are also envisioned for use with the present invention. Alternative embodiments of the access region or device 24 can be single or minimal use access devices, folding flaps, spouts, holes, and the like. For instance, a peel seal as described herein can be included with or without a zipper for such embodiments where re-closeability is not desirable or needed. In such an embodiment, the region 24, such as that shown in FIG. 1, can simply include a temporary peel seal 24, or a peel seal utilized in combination with and proximate a re-closeable device 24. Further, the access device can be disposed along any portion of the package 10 without deviating from the present invention.

As demonstrated in the embodiment of FIGS. 1-11, the package 10 is generally formed to define a top gusseted impact region or panel portion 20. Such an embodiment of the package 10 can include side panel portions 16, 18, such that the top gusseted portion 20 can be formed by the folding and sealing of portions of the front and/or back panel portions 12, 14. For instance, the juncture of the side panel portions 16, 18 with the panel portions 12, 14 can include folds and/or seals 30, 32, 34, 36. These seals 30-36 can be defined by folds, folds and seals, and the like. Embodiments employing seals can utilize heat seals, adhesive bonding, and various other known sealing techniques. Seal regions are generally depicted in the figures with cross-hatching.

As shown in FIGS. 1-4, seals 30, 34 are provided at the juncture of the front panel portion 12 with the side panel portions 16, 18. Seals 32, 36 are provided at the juncture of the back panel portion 14 with the side panel portions 16, 18. Further, in such an embodiment, the seals 30, 34 can run a distance short of the length of the seals 32, 36, leaving a remaining edge length 38 generally free from folds or seals proximate the top of the front panel 12. In other embodiments, each of the seals 30-36 can run various lengths in comparison to the lengths of panels 12, 14 without deviating from the spirit and scope of the present invention. The free edge length 38 can be originally formed without a seal or can be created by slitting, scoring or cutting down a distance in the package 10 or seals 30, 34.

Figure 4:
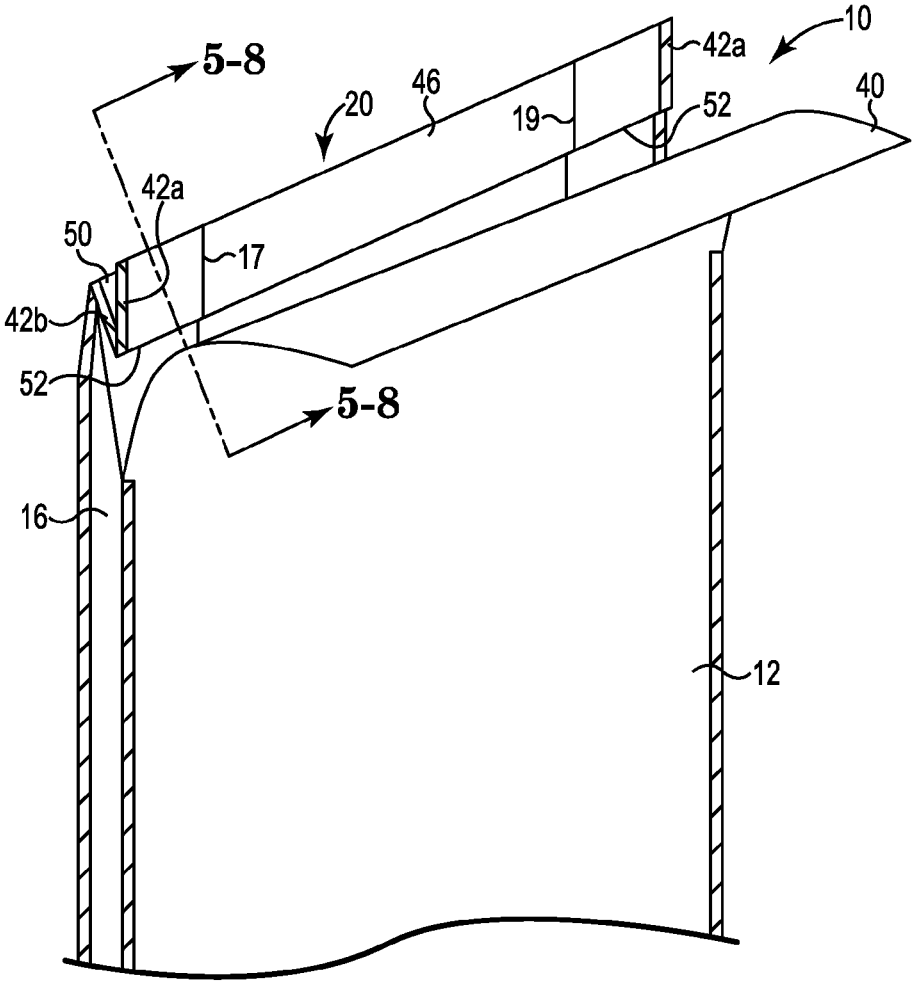
FIG. 4 is a perspective view of the package of FIG. 2 folded at the side gusset panels and the back panel in accordance with an embodiment of the present invention.
Figure 11:
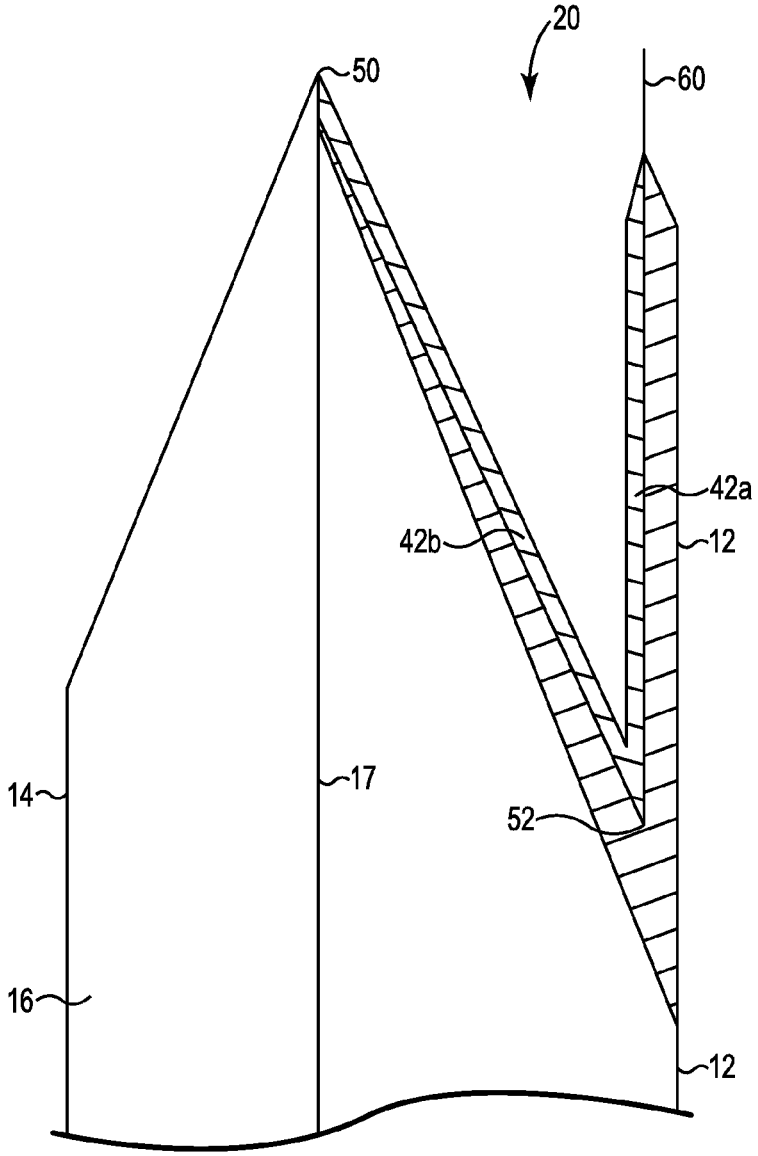
FIG. 11 is a close-up view of sealed portions of the top gusseted panel of the package of FIG. 1 in accordance with an embodiment of the present invention.
Figure 12:
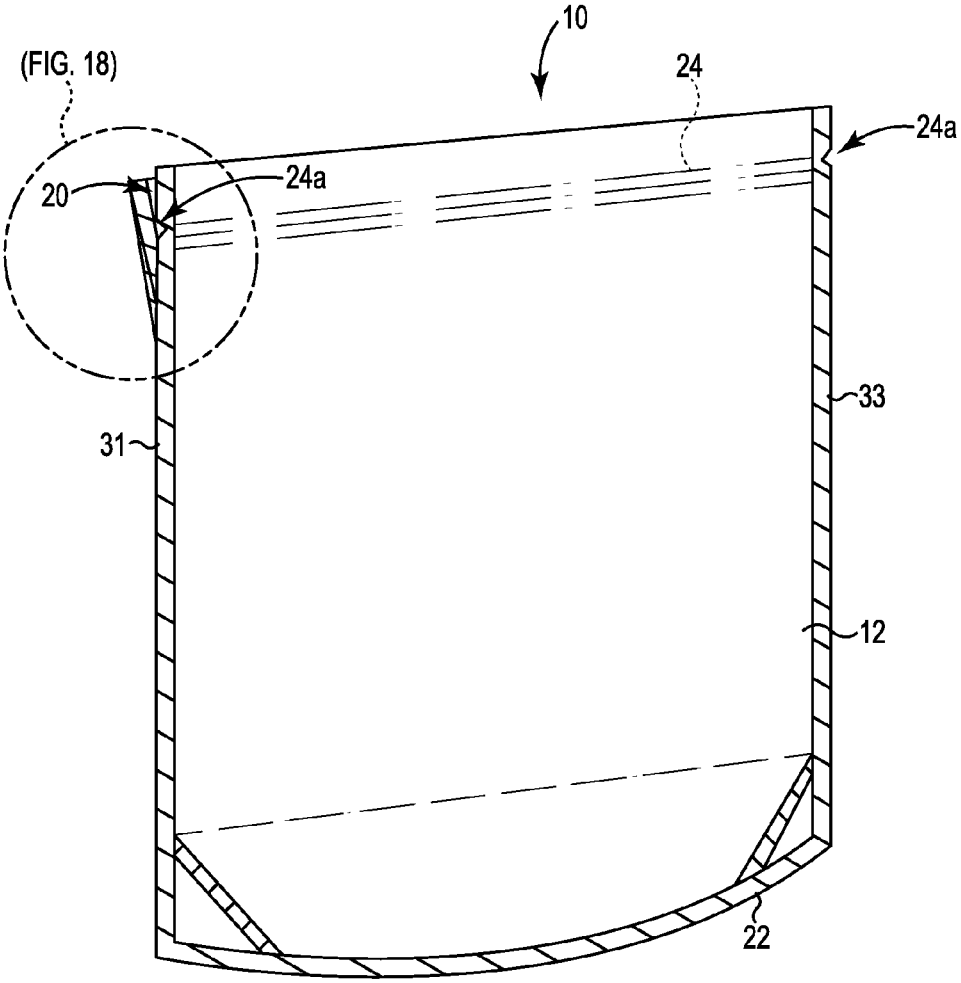
FIG. 12 is a perspective view of a package having a gusseted impact barrier in accordance with an embodiment of the present invention.

As demonstrated in the embodiment of FIGS. 2-8, the formation, via machine or manual, of the package 10 can include folding, bending or otherwise manipulating the front panel portion 12 to create a front flap 40. Similarly, the side panel portion 16 along a portion of length 38 can be positioned and collapsed inward toward the back panel portion 14 such that an edge region or portion 42 of the panel 16 angles toward the back panel portion 14, away from the flap 40. In addition, the back panel portion 14 can be folded upon itself at fold lines 50, 52, sandwiching or enclosing the edge 42 and a top portion of the side panels 16, 18 therein to define first edge portions 42*a* and second edge portions 42*b* on either side of or divided by fold 52, as shown in FIG. 4. These folds 50, 52 can define the top gusseted portion 20 with a material impact portion 48 and a top end portion 46. The top end portion 46 generally includes the layered materials of the folded back panel portion 14 and the top of the folded side panel portions 16, 18. At least first edge portions 42*a* are operatively (e.g., directly or indirectly) sealed or otherwise joined to an inner sealant surface of the front panel portion 12. Sealing the edges 42*a* to the front panel portion 12 positions the fold 52 within the compartment 25, providing the impact portion 48 across a significant area within the compartment 25 while simultaneously allowing for contents 11 to traverse a flow gap 55. The flow gap 55 can vary in size depending on the content traversal needs as well as the length or size of the impact portion 48. The flow gap 55 is provided between top portion 46 and front panel 12 because the referenced sealing is generally limited to the edges 42*a* and not the entire length of portion 46. However, a peel seal 47 (shown with exaggerated thickness and proportions in FIG. 8) can be provided along a portion of material 46 (e.g., below an access device 24) that extends between the edges 42*a* to temporarily seal material 46 to the opposing panel 12 to further assist in maintaining gusset portion 20 in a position to protect any access device 24 or other structural portions of the package 10 proximate the top portion of the front panel 12. This peel seal feature can provide additional protection from the material contents 11 during shipping and handling that occurs before the user opens the package. When the user opens up, or tears or releases, a portion of region or device 24, at a top portion of the front panel 12, the peel seal can then be released, providing the benefits of access into the internal compartment 25 while simultaneously retaining the benefits of the impact barrier and gusseted portion 20. The close-up view of FIG. 11 shows the herein-referenced edge seal portions in cross-hatching, with the thickness and proportions exaggerated for demonstrative purposes.

Various folding configurations and designs can be implemented in alternative embodiments to form the top gusseted portion 20. For illustrative purposes, the details of the folds and gusset formation are shown and described along side panel portion 16. However, corresponding like folds and/or seals as described herein can be applied to the opposing side panel portion 18 along and with respect to the relationship with the front and back panel portions 12, 14 to create the gusseted top panel portion 20 extending a length between the panel portions 16, 18. Moreover, the gusseted top panel portion 20 can be reversely configured such that the flap 40 extends from the back panel portion 14, the impact portion 48 (or portion 46) extends angled from the back panel portion 14 toward the front panel portion 12, and the device 24 is integrated or provided along a portion of the back panel portion 14.

As demonstrated with the top gusset configuration of FIGS. 5-10, the gusseted impact portion 20 along fold 52 creates the extending material impact barrier 48, positioned generally below the re-closeable device 24. In one embodiment, as shown in FIG. 6, excess material of the flap 40 is cut down or otherwise reduced in size to generally match the height of the gusseted portion 20 at the top end portion 46.

Figures 5, 6, 7:
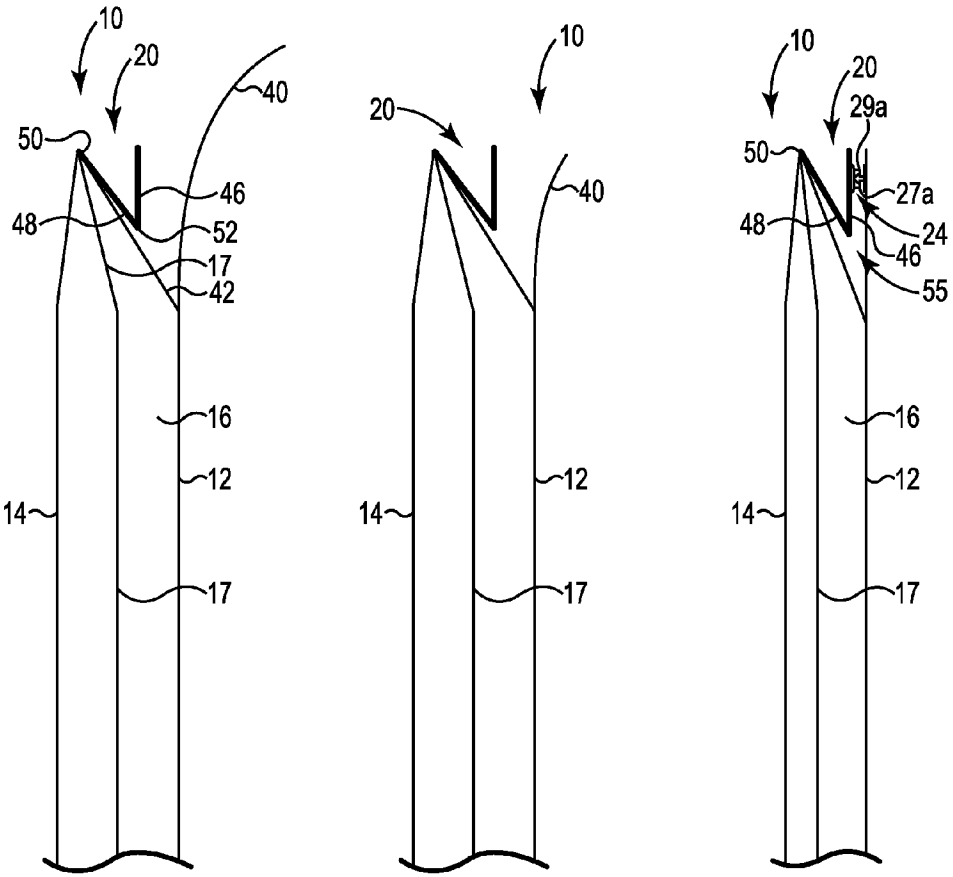
FIG. 5 is a cross-sectional schematic view of the package of FIG. 4 with a front panel flap and folded back and side panels.
FIG. 6 is a cross-sectional schematic view of the package of FIG. 4 with the front panel flap trimmed.
FIG. 7 is a cross-sectional schematic view of the package of FIG. 4 with a re-closeable device attached to the top gusseted panel and front panel.
Figure 8:
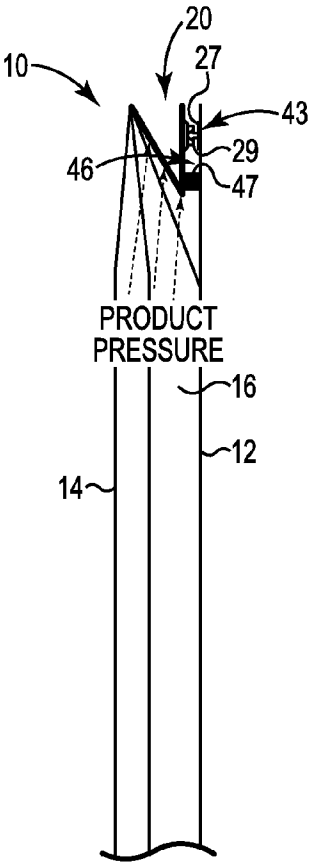
FIG. 8 is a cross-sectional schematic view of the package of FIG. 4 with a re-closeable device attached to the top gusseted panel and front panel, illustrating product pressure on the top gusseted panel.

A device portion or flange 27 of the re-closeable device 24 can be disposed along the front panel portion 12 with a second device portion or flange 29 being disposed proximate the end portion 46 of the gusset portion 20, as shown in FIGS. 7-8. In an embodiment of the invention employing a mating re-closeable zipper, the first device portion 27 can include a male profile member 27*a* and the second device portion 29 can include a female profile member 29*a*, interlockable to provide selective access into the internal compartment 25 via the access opening 23.

Figure 17:
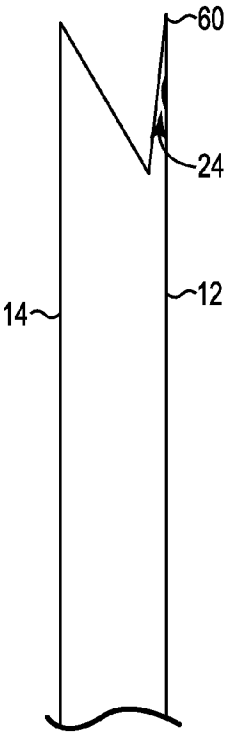
FIG. 17 is a cross-sectional schematic view of the package of FIG. 13 with an access device attached to the front panel.

In other embodiments, the device 24 can be fully disposed along a portion of a single panel, such as the front panel portion 12 demonstrated in FIG. 17. As described herein, various device configurations and positions are envisioned for implementation with the present invention. For instance, the top flap 40 can be used as a handle, or otherwise used to assist with handling, use, etc. Non re-closeable, or limited use access devices, such as peel seal films, tear openings, and the like can be utilized and are envisioned for use with the present invention. For instance, the region 24 of FIG. 1 can be a tear region 24 including a scored or perforated region 24*a* adapted for tearing away by the user to gain access into the package 10. This tear region 24 could be used in combination with or in lieu of an access device such as a re-closeable device.

Figure 10:
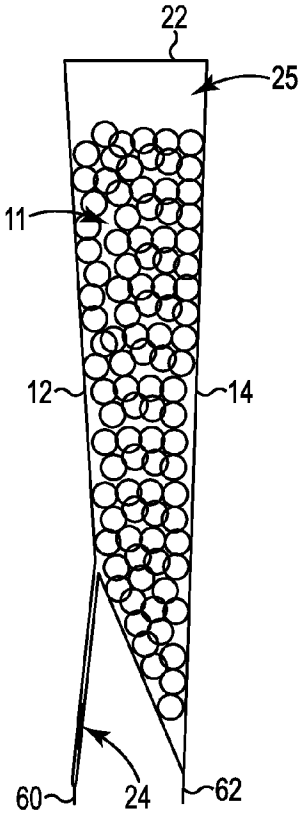
FIG. 10 is a cross-sectional schematic view of the package of FIG. 1 turned upside down, with the material contents substantially impacting the top gusseted panel.
Figure 9:
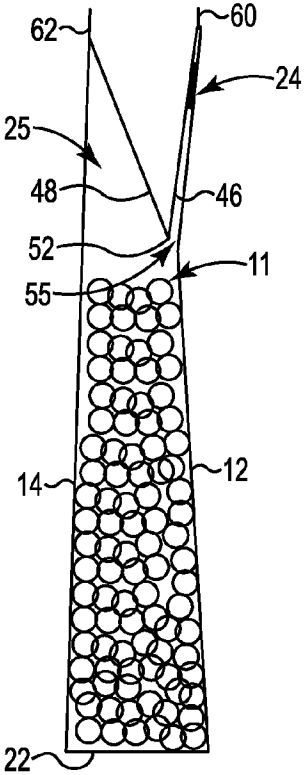
FIG. 9 is a cross-sectional schematic view of the package of FIG. 1 with a top gusseted panel, material contents and a re-closeable device, in accordance with an embodiment of the present invention.

As shown in FIGS. 9-10, seals 60, 62 can be provided at the top of the package 10 to seal off the film or package materials of the top gusset portion 20. Seal 60 can seal the end region of portion 46 to the top of the front panel portion 12. Seal 62 can seal the fold 50 with a top portion of the back panel portion 14. The fold 50 can also be included without seal 62 running therealong. Each of the seals 60, 62 can be known permanent or destruct seals, peel seal or temporary seals, and the like. With such a configuration, material contents 11 are accessible within the internal cavity 25, through access opening 23 and re-closeable device 24. The seal 60 or portions of the front panel 12 proximate access region or device 24 can be notched, tabbed, scored or otherwise adapted to permit a user to pull open, cut or tear off material to gain access to the internal compartment 25.

Gusseted panel portion 20 can be left open, or slit open or unsealed, proximate or at the fold 50 to permit filling of the package 10 with the material contents. The entire package 10 may be formed, including the sealing of edges 42*a* to the front panel portion 12, with the slit or opening provided at fold 50. As such, after the package 10 has been filled with content 11 through the referenced opening after formation, fold 50 (or the slit or opening) can be sealed off and the package 10 prepared for consumer use. This may be particularly useful for a package 10 of the present invention having a bottom gusseted panel 22 that is sealed during formation, thus closing off a primary means of filling the package 10. The opening in gusseted panel portion 20 can provide the necessary fill opening. It is noted that the addition of the gusseted panel portion 20 of the present invention provides an additional external display area, such as that utilized to provided logos, graphics, and the like.

When the package is positioned generally upside down, or subjected to a drop test, the material contents 11 generally flow toward the top of the package 10 and substantially impact the gusset portion 20 rather than the structure of the device 24, as demonstrated in FIG. 10. Namely, the material barrier 48 running from the fold 52 to the top seal 62 or fold 50 absorbs most if not all of the impact and weight of the material contents 11, while simultaneously permitting expansion or give about the gusset fold 52. Contents 11 that impact the material barrier 48 of the gusset 20 tend to initiate an impact trigger position whereby barrier 48 and fold 52 are pushed toward the front panel 12 (in a front panel device 24 embodiment), thereby substantially preventing the contents 11 from impacting the device 24 or those panel portions carrying or proximate the device 24. Moreover, the top gusset 20 can absorb impact even after the user or consumer has initially opened the package 10. The gusset 20 and impact barrier 48 are not removed with the opening of the package or use of the device 24 (re-closeable or not), thereby retaining the structural impact features of the gusset 20.

While the material barrier 48 of the gusseted impact portion 20 can control impact load and redirect contents 11 away from the device 24, the access gap 55 is provided that can facilitate access to the contents 11 through the opening 23 or access device 24. For instance, a user can tip or angle the package 10 to direct the contents 11 along the plane of the panel portion 12 and toward the device 24 through the access gap 55, without directing the contents 11 into the impact barrier 48 of the gusset portion 20. In addition, a user can manipulate the flexible, or relatively flexible, panel portions (e.g., panel portions 12, 20) to open up or expand the access gap 55, or pull back the gusset portion 20 from its triggered position, thereby pulling fold 52 away from panel portion 12 and increasingly opening up the access gap 55 to allow the contents 11 to flow toward the device 24.

Figure 13:
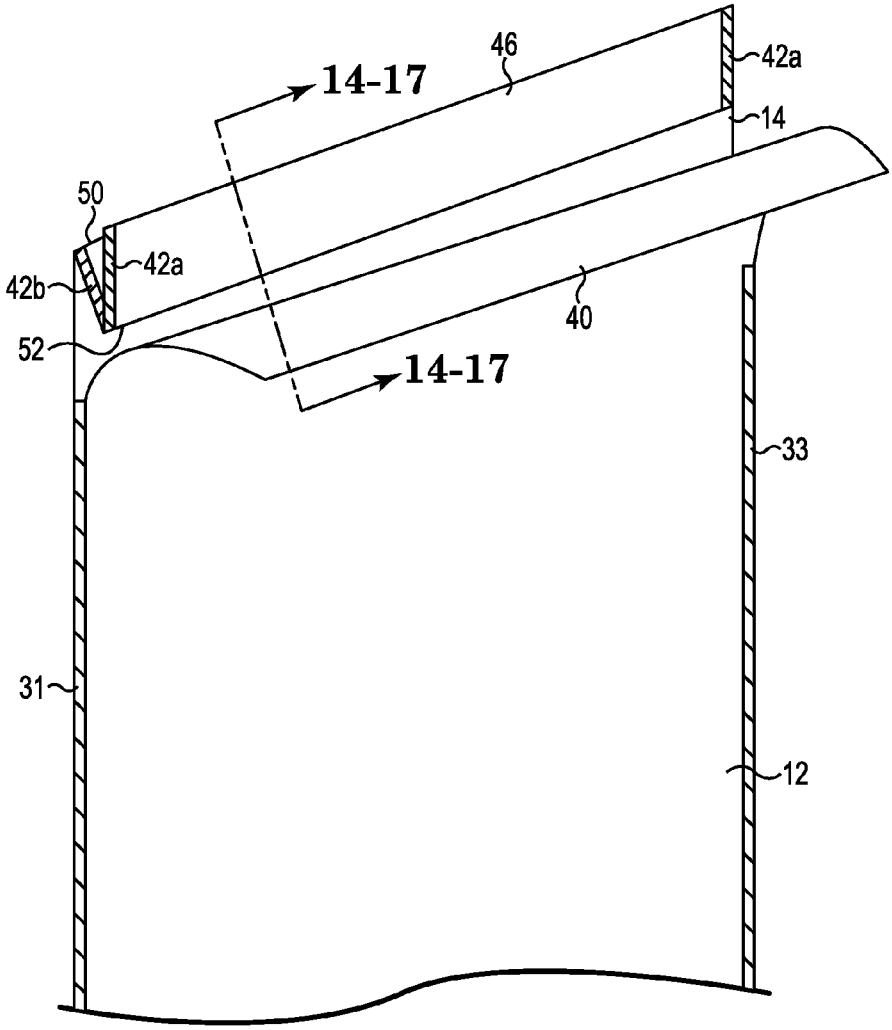
FIG. 13 is a perspective view of a package folded at the back panel in accordance with an embodiment of the present invention.
Figure 14:
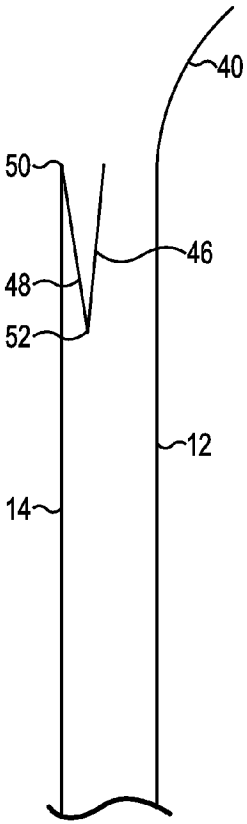
FIG. 14 is a cross-sectional schematic view of the package of FIG. 13 with a front panel flap and folded back panels.
Figure 15:
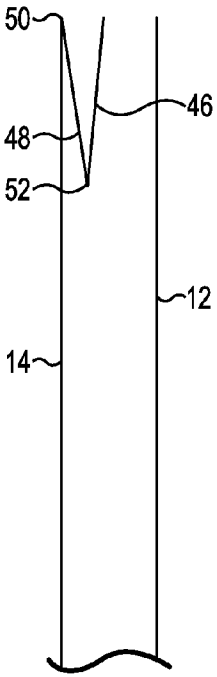
FIG. 15 is a cross-sectional schematic view of the package of FIG. 13 with the front flap trimmed.
Figure 16:
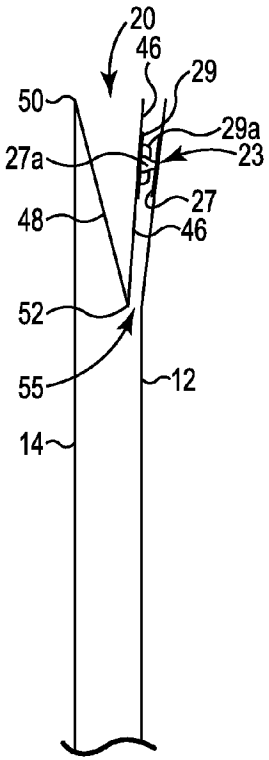
FIG. 16 is a cross-sectional schematic view of the package of FIG. 13 with a re-closeable device attached to the top gusseted panel and front panel.

As depicted in FIGS. 12-18, the package 10 and the top gusset portion 20 can be formed without side panel portions 16, 18. In such an embodiment, the back panel portion 14 can be folded over itself to form the folds 50, 52, as shown in FIGS. 13-17. The flap 40 of the front panel portion 12, like that of the side panel embodiment, extends out from the front panel portion 12 and can be cut off or otherwise reduced in size to match the top end portion 46 of the folded back panel portion 14, as shown in FIGS. 13-15. Accordingly, the device 24 can be attached to the front panel portion 12, or as otherwise detailed herein for the present invention. Side seal portions 31, 33 can run various lengths of the package as discussed hereinabove. Further, slits, scores or other features can be implemented at the edge junctures of the front and back panels.

Figure 18:
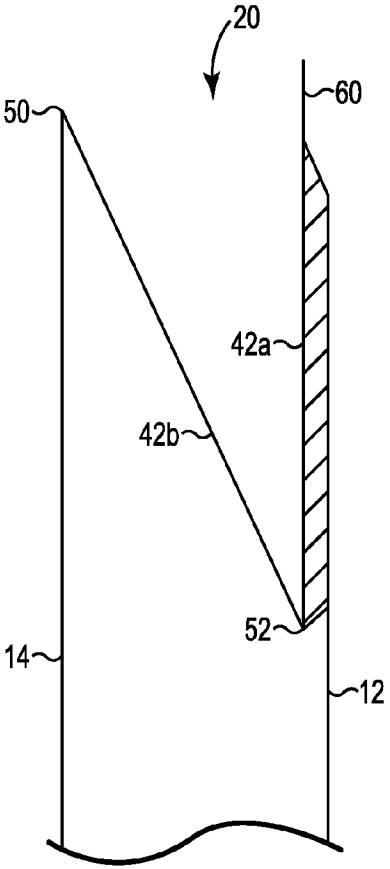
FIG. 18 is a close-up view of sealed portions of the top gusseted panel of the package of FIG. 12 in accordance with an embodiment of the present invention.

Again, the gusset material generally defined from fold 52 and on to fold 50 provides the load barrier 48 adapted to protect the device 24 from damage from the material contents 11 during shipping, handling, use or planned drop tests. Edge portions 42*a*, 42*b* are on either side of or divided by fold 52, as demonstrated in FIG. 13. Edge portions 42*a* can be operatively sealed or otherwise joined to the inner sealant surface of the front panel portion 12. Sealing the edges 42*a* to the front panel portion 12 positions the fold 52 within the compartment 25, providing the impact portion 48 along a significant area within the compartment 25 while simultaneously allowing for contents 11 to traverse the flow gap 55. The flow gap 55 is provided between top portion 46 and front panel 12 because the referenced sealing is generally limited to the edges 42*a* and not the entire length of 46. However, a peel seal 47 as described and depicted herein can be employed to temporarily seal a region of portion 46 to the front panel 12. The close-up view of FIG. 18 shows the herein-referenced edge seal portions in cross-hatching, with the thickness and proportions exaggerated for demonstrative purposes.

Various figures and descriptions disclose features and accessories. However, it must be noted that these features are merely illustrative in nature and may be placed in varying locations and under varying configurations, and still be consistent with the present invention. Various regions of the package can include a handle portion, access devices, and the like. In addition, the shape and configuration for the panel portions are also merely illustrative and can be altered without deviating from the spirit and scope of the present invention. Any of the panel portions, or selected regions thereof, can include various aesthetic and functional graphics, such as logos, instructions, advertising, bar codes, and the like. These graphics can run transverse, parallel, or even in a diagonal orientation to the longitudinal panel edges discussed herein.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive package 10.

What is claimed is:

1. A flexible package having an internal compartment, comprising:

a first panel portion having an interior surface, an exterior surface and a top edge portion;

a second panel portion having an interior surface, an exterior surface and a top edge portion;

at least one gusseted side panel portion having a longitudinal fold line;

a gusseted panel portion having an interior surface, an exterior surface, and extending between the first and second panel portions, with portions of the at least one gusseted side panel and the longitudinal fold line folded with the gusseted panel portion to define a multi-layer edge portion sealed to the interior surface and the top edge portion of the first panel portion, the gusseted panel portion further having a gusset fold to define an impact barrier extendable within the internal compartment; and a re-closeable access device having a first flange portion and a second flange portion, the first flange portion provided along a portion of the interior surface of the first panel portion, with the second flange portion provided along a portion of the interior surface of the gusseted panel portion opposing the first flange portion.

2. The flexible package of claim 1, wherein the at least one gusseted side panel portion includes first and second gusseted side panel portions.

3. The flexible package of claim 1, wherein the re-closeable access device includes a re-closeable zipper device.

4. The flexible package of claim 3, wherein the first flange portion includes a male profile member and the second flange portion includes a female profile member.

5. The flexible package of claim 1, wherein the gusseted panel portion extends between top portions of the first and second panel portions to define a gusseted top panel portion.

6. The flexible package of claim 1, further including a tear away portion proximate the top edge portion of the first panel portion to facilitate access into the internal compartment.

7. A gusseted package, comprising:

a first panel portion having an interior surface, longitudinal first panel edge portions and a first end portion generally transverse to the longitudinal first panel edge portions;

a second panel portion having longitudinal second panel edge portions, the second panel portion and the first panel portion at least partially defining an internal compartment;

first and second gusseted side panels each having a longitudinal fold;

a re-closeable access device having a first member selectively mateable with a second member; and a gusseted panel portion extending between the first and second panel portions, the gusseted panel portion having a gusset fold extendable a distance into the internal compartment to define an impact barrier and including multi-layer edge portions including folded portions of the longitudinal fold of the first or second gusseted side panels such that the multi-layer edge portions are sealed to the interior surface and a seal portion of the first end portion of the first panel portion, with the first member of the re-closeable access device disposed along a portion of the interior surface of the front panel portion, and with the second member of the re-closeable access device disposed along a portion of the gusseted panel portion.

8. The gusseted package of claim 7, wherein the re-closeable access device is a re-closeable zipper device.

9. The gusseted package of claim 7, wherein the gusseted panel portion extends between top portions of the first and second panel portions to define a gusseted top panel portion.

10. The gusseted package of claim 7, wherein the gusseted panel portion extends between bottom portions of the first and second panel portions to define a gusseted bottom panel portion.

11. The gusseted package of claim 7, wherein a portion of the gusseted panel portion is connected with a peel seal to the first panel portion.

12. A flexible package having an internal compartment, the flexible package comprising:

a first panel portion having an interior top seal surface and longitudinal edge portions;

a second panel portion having longitudinal edge portions;

at least one side panel portion;

a gusseted panel portion extending between the first and second panel portions and including a multi-layer edge portion including folded portions of the at least one side panel portion such that the multi-layer edge portion is sealed to the interior top seal surface of the first panel portion to define an impact barrier within the internal compartment; and an access device having a first device portion and a second device portion, with the first device portion of the access device disposed along a portion of the first panel portion and the second device portion of the access device disposed along a portion of the gusseted panel portion.

13. The flexible package of claim 12, wherein the at least one side panel portion includes first and second side panel portions.

14. The flexible package of claim 13, wherein at least one of the first and second side panel portions is gusseted.

15. The flexible package of claim 12, wherein the access device includes a re-closeable access device.

16. The flexible package of claim 15, wherein the first device portion includes a first flange portion disposed along the front panel portion and the second device portion includes a second flange portion disposed along the gusseted panel portion.

17. The flexible package of claim 12, wherein the gusseted panel portion extends between top portions of the first and second panel portions to define a gusseted top panel portion.

18. The flexible package of claim 12, wherein the gusseted panel portion extends between bottom portions of the first and second panel portions to define a gusseted bottom panel portion.

19. The flexible package of claim 12, further including a peel seal provided to temporarily seal a portion of the gusseted panel portion to the first panel portion.

* * * * *